United States Patent [19]

Corbic

[11] 4,155,786

[45] May 22, 1979

[54] PROCESS AND APPARATUS FOR STERILIZING A THERMOPLASTIC BAND

[75] Inventor: Yves J. Corbic, Chatou, France

[73] Assignee: Gatrun Anstalt, Vaduz, Liechtenstein

[21] Appl. No.: 750,959

[22] Filed: Dec. 15, 1976

[30] Foreign Application Priority Data

Dec. 17, 1975 [FR] France ..... 75 38743

[51] Int. Cl.[2] ..... B65B 47/02; B65B 47/08

[52] U.S. Cl. ..... 156/69; 219/243; 219/388; 264/555; 432/8; 432/59; 432/60; 432/228; 422/1; 53/556

[58] Field of Search ..... 21/61, 91, 93, 2, 78; 432/8, 59, 60, 228; 53/167, 184 R, 30 R, 22 A, 112 A; 156/69; 264/92; 219/201, 243, 244, 385, 388

[56] References Cited

U.S. PATENT DOCUMENTS

| | | | |
|---|---|---|---|
| 3,653,175 | 4/1972 | Rogiers | 53/184 |
| 3,687,426 | 8/1972 | Bemberg | 432/59 |
| 3,805,486 | 4/1974 | Mahaffy et al. | 53/184 |
| 3,859,774 | 11/1975 | Bausch | 53/167 |
| 3,947,249 | 3/1976 | Egger | 21/93 |
| 4,001,546 | 1/1977 | Johnson et al. | 432/60 |
| 4,045,945 | 9/1977 | Moller et al. | 53/167 |

*Primary Examiner*—John E. Kittle

*Attorney, Agent, or Firm*—Weingarten, Maxham & Schurgin

[57] ABSTRACT

The invention relates to a process and an apparatus for sterilizing a thermoplastic band used in the production of sterile packs.

During the sterilization operation in the sterilization zone the edge of the thermoplastic band which subsequently forms the inside of the pack is applied to a movable sterilization support which is heated to the sterilization temperature and accompanies the band over part of its path to the shaping station located in the sterile enclosure and the contact being maintained between the support and the band until the latter enters the sterile enclosure.

The sterilization installation comprises a sterilization zone, a thermoplastic band and conveying and guidance means for said band to said zone and heating means which heat the band to the sterilization temperature, whereby in the sterilization zone at least one of the parts of the thermoplastic band conveying means is constructed as a movable sterilization support which comes into contact with the band and extends transversely over the entire width of the band, the heating means being located in the vicinity of the sterilization support.

50 Claims, 11 Drawing Figures

VIII
VIII

PROCESS AND APPARATUS FOR STERILIZING A THERMOPLASTIC BAND

BACKGROUND OF THE INVENTION

The present invention relates to a sterilization process for a thermoplastic band used in the production of sterile packs such as containers or pots obtained in a mould, more particularly by deep drawing under pressure or pneumatic suction of the said band, whereby at least the side of the thermoplastic band which will constitute the inside of the pack undergoes heat treatment whilst supporting the said band and prior to conveying it to the shaping, filling and sealing stations for the said packs, which are optionally at least partly located in a sterile enclosure.

According to a known embodiment of this process, the said thermoplastic band is heated by radiation, said band being heated to the shaping temperature in order to sterilise the same to a more or less high degree. Due to the fact that during this heating process, prior to shaping the packs by deep drawing, the thermoplastic material softens to a greater or lesser extent whereby pockets or curved surfaces can form it has already been proposed to support the central area of the thermoplastic band upstream of the shaping station by means of an endless conveyor belt (cf French Pat. No. 2,028,765). However, the temperatures used in the heating station for softening the thermoplastic bands with a view to its subsequent deep drawing are generally too low to ensure an acceptable and effective sterilization of the thermoplastic band, at least on the side which is subsequently to form the inside of the packs. The sterilization temperature is in fact generally above the softening temperature of thermoplastic materials.

To be able to heat the side of the thermoplastic band which will subsequently become the inside of the packs to sterilization temperatures which are significantly above the softening temperatures of the thermoplastic materials used in the production of packs, thus ensuring an almost complete destruction germs, it has been proposed more particularly in French Pat. Nos. 1,192,697 and 1,198,791 to heat one of the sides of the thermoplastic band to a high temperature of the order, for example, of 250° C. by thermal radiation, whilst simultaneously cooling the other side of said band in order to avoid damage thereto. It is readily understandable that this process consumes much more energy due to the fact that simultaneous action takes place on the inside of the thermoplastic band with temperature gradients which are opposed to one another.

BRIEF SUMMARY OF THE INVENTION

The object of the present invention is to propose a sterilization process of the type indicated hereinbefore and which ensures an effective sterilization at lower sterilization temperatures, consequently with reduced energy consumption.

According to the present invention, this object is achieved in that during sterilization operation in the sterilization zone the side of the thermoplastic band which will subsequently form the inside of the packs is applied to a movable sterilization support which is heated to the sterilization temperature and which accompanies said band over part of its path towards the shaping station and in that contact is maintained between the movable support and the band until the latter enters the sterile enclosure.

As a result of this measure, a direct and rapid heat transfer takes place, accompanied by effective sterilization, whilst energy consumption is low. It has been found that the degree of sterilization, expressed as the number of living germs per unit of surface area after treatment is highest when contact between heated sterilization support and thermoplastic band is perfect. It has also been found that inclusions of air or other gases between the thermoplastic band and the movable sterilization support aid the resistance of the germs. Thus, according to another characteristic of the present process, at the upstream end of the sterilization zone, that is to say in the zone where the thermoplastic band and the heated support come into contact, said band is applied flat and preferably in accordance with a straight line extending transversely to its longitudinal extension between its two longitudinal edges against the movable heated support. Due to this measure, the thermoplastic material of the band flows and adheres to its support substantially as soon as it comes into contact with the heated support, thus preventing any air inclusion. Due to the fact that the thermoplastic band tightly adhers to the heated support, it is unnecessary to carry out the sterilization process in a tight sterile container. Moreover, when for some reason or other, the sterilization process and in general manner the sterile packing process has had to be interrupted, it is possible to recommence the process without losing time through presterilizing the sterilization means, such as the movable support.

Advantageously, the sterilization times exceed 10° seconds and do not exceed 120 seconds, whilst the sterilization temperatures are of the order of 130° to 240° C. and preferably are of the order of 140° to 220° C.

In order to ensure a separation between the thermoplastic band and its movable sterilization support, at the downstream end of the sterilization zone of the said thermoplastic band, the latter is cooled, preferably suddenly and preferably only superficially to a temperature which, locally and superficially can be below the softening temperature but which, after adjusting to the temperature of the inner mass of the thermoplastic band reaches the overall temperature for the band which is at least equal to the heat-shaping temperature of the containers.

As a result of this transient and preferably sudden cooling, the skin of the thermoplastic band contracts sufficiently to stop it adhering to the sterilization support.

Advantageously, the movable sterilization support is a metallic member, whose periphery is defined by a cylindrical surface and which preferably comprises a drum or an endless belt.

The invention also relates to an insulation for the sterilization of a thermoplastic band which is to be subsequently used in the production of sterile containers or pots by heat shaping the said band, whereby said insulation comprises a sterilization chamber, a thermoplastic band and conveying and guidance means for the said band through the sterilization chamber and heating means making it possible to heat the said band to the sterilization temperature.

An installation of this type is known, for example, from French Pat. Nos. 1.192,697 and 1,198,791, but the latter installation requires cooling means facing the heating means in order to avoid damage to the thermoplastic band. Moreover, this known installation consumes unnecessarily large quantities of energy and requires a prior sterilization of the various members and components thereof before each starting up thereof, following a voluntary or involuntary stoppage of the complete installation.

One of the objects of the present invention is to propose an installation of the type indicated hereinbefore, which eliminates the above disadvantages and which permits in a limited time and with limited energy consumption an effective and reliable destruction of germs on the side of the thermoplastic band which will constitute the inside of the containers or pots subsequently formed by pot deep drawing under pressure and/or in vacuum.

According to the present invention, this object is achieved in that within the sterilization chamber at least part of the conveying means for the thermoplastic band is constructed as a movable sterilization support which comes into contact with the said band and extends transversely over the entire width of said band, whilst the heating means are located in the vicinity of the sterilization support.

As a result of this construction, the thermoplastic band can be rapidly heated to the sterilization temperature and the thermoplastic material which at said sterilization temperature has a tendency to flow is effectively supported by the sterilization support, without there being any relative movement between said support and the thermoplastic band, which also adhers to said support at the sterilization temperatures. Moreover, whilst the thermoplastic band remains stuck to its sterilization support, the sterilized side of the band cannot be contaminated by the ambient atmosphere which is not necessarily sterile in the sterilization zone.

In order to have a highly effective heat transfer towards the side of the thermoplastic band which will constitute the inside of the sterile container, at least part of the outer wall of the sterilization support serves for the heat transfer between the thermoplastic band and the heating means which are located in the said support, preferably in the vicinity of at least part of its face coming into contact with said band. The movable sterilization support face which comes into contact with the thermoplastic band is materialised by a good heat conducting sheet or wall and is preferably made from metal. The contact face is smooth. The sterilization support can comprise a rotary drum in which are incorporated the heating means. The sterilization support can also comprise an endless conveyor belt and at least two return rollers on which passes said endless belt. In order to ensure a good contact between the thermoplastic band and the movable sterilization support, the installation comprises, facing the upstream end of the sterilization support, at least one applicator roller whose position and pressure are regulatable and which can apply the thermoplastic band to the sterilization support. At least one of the return rollers of the endless conveyor belt of the sterilization support is provided with heating and/or cooling means. The return roller equipped with the heating means can comprise a rotary drum whose diameter is greater than that of the other return roller. The heating means of the sterilization support can comprise at least one heating plate, such as a sole plate fixed within the loop formed by the endless conveyor belt. The heating or sole plate is located below the upper strand of the conveyor belt of the sterilization support. When the heating means comprise a plurality of heating or sole plates located within the loop formed by the conveyor belt, one of the said heating plates is fixed in the vicinity of and below the upper strand of the conveyor belt and the other heating plate is fixed in the vicinity of and above the lower strand of the said conveyor belt. In the case where the sterilization support comprises more than two return rollers, the latter are arranged so as to determine for the conveyor belt passing around them a path having at least two portions which are inclined and preferably strongly inclined relative to the horizontal, in such a way that the strands of the conveyor belt located on these inclined portions of the belt path are also inclined and preferably strongly inclined relative to the horizontal and are preferably at least approximately vertical. The return rollers associated with the strands, which are approximately vertical, of the conveyor belt can be staggered. A heating plate is positioned at least between the first two approximately vertical strands of the conveyor belt and which follow the upstream end of the sterilization support. When the sterilization support has at least two heating plates, the heating plate associated with the upstream zone of the support is heated to a temperature above that to which is heated the plate associated with the downstream zone of said support and which is preferably heated to a temperature at least equal to or higher than the heat shaping temperature of the thermoplastic band. The return roller located on the path of the thermoplastic band along the endless conveyor belt between two heating plates heated to different temperatures is constructed as a cooling roller equipped with cooling means. At the downstream end of the sterilization zone of the movable sterilization support it is possible to provide cooling means which serve to reduce, preferably suddenly, the temperature of the thermoplastic band and cause a slight contraction of the latter in order to aid its separation from the sterilization support. The cooling means can be positioned within the return roller for the conveyor belt and which is located at the downstream end of the sterilization zone of the sterilization support. The cooling means can also comprise a cooling roller arranged externally of the loop formed by the conveyor belt at the downstream end of the sterilization zone and applied against said conveyor belt, preferably at the location of the return roller associated with the downstream end of the sterilization zone. The cooling means can also comprise a cooling plate which faces the conveyor belt within the loop formed by the latter, at the downstream end of the sterilization zone of the sterilization support. To the extent that the path of the thermoplastic band must be deflected from the path of the conveyor belt at the downstream end of the sterilization zone, a take-up and return roller is provided at said downstream end externally of the loop formed by the conveyor belt and drawn in the direction of the latter. At least in the vicinity of the downstream end of the sterilization zone of the sterilization support the installation comprises a sterile enclosure having an intake chamber for the thermoplastic band, when the latter leaves its sterilization support. The intake chamber can be materialised by an opening made in the sterile enclosure and tightly bordering the downstream end of the movable sterilization support, whereby one of the transverse edges of this opening is applied to the non-sterilized side of the thermoplastic band, whilst the other transverse edge is tightly applied to the conveyor belt downstream of the separation point between conveyor belt and thermoplastic band. The cooling means and/or take-up and return roller are provided in the zone defined by the two transverse edges of the opening of the intake chamber. Between the transverse edge of the intake chamber opening located on the side of the thermoplastic band and said band, it is possible to provide a roller, preferably a cooling roller whose periphery is applied tightly both against the said transverse edge and the non-sterile side of the thermoplastic band, whilst moving synchronously with the latter. It is also possible to provide elastic restoring means which draw the conveyor belt against the transverse edge of the intake chamber opening located downstream of the separation point between the thermoplastic band and the conveyor belt.

BRIEF DESCRIPTION OF THE DRAWINGS

Other and further objects of the present invention will be apparent from the following description and claims and are illustrated in the accompanying drawings which, by way of illustration, show preferred embodiments of the present invention and the principles thereof, and what are now considered to be the best modes contemplated for applying these principles. Other embodiments of the invention embodying the same or equivalent principles may be used and structural changes may be made, if desired, by those skilled in the art without departing from the invention and the scope of the appended claims.

In the drawings show.

DETAILED DESCRIPTION OF THE PREFERRED EMBODIMENTS

Figure 1:
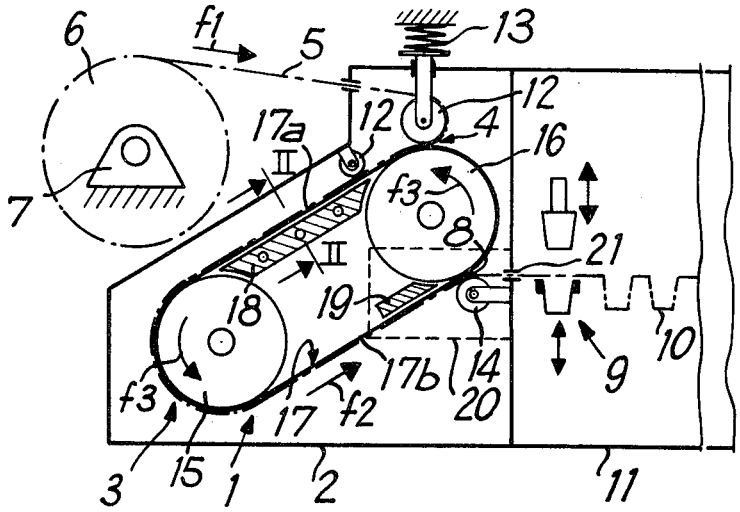
FIG. 1 a schematic elevational view of a first embodiment of the sterilization installation for thermoplastic bands.

In general manner, the sterilization installation comprises a movable sterilization support 1 optionally provided in a working container 2 which can, but need not, be maintained sterile. Along the said sterilization support 1 extends a sterilization zone 3 whose upstream end is located at position 4 where the thermoplastic band 5 unwound in the direction of arrow $f_1$ from a storage reel 6 comes into contact for the first time with the sterilization support 1. The storage reel 6 of the thermoplastic band 5 is mounted on a support indicated schematically by the reference numeral 7. The downstream end of sterilization zone 3 is defined by the position 8 where the thermoplastic band 5, after passing along the sterilization support 1 in the direction of arrow $F_2$ discontinues contact with sterilization support 1 and is then directed towards another station, for example a shaping station 9 which, like the other stations of a not shown conditioning installation, is surrounded by a sterile enclosure 11. Examples of such stations are the filling and sealing station of the containers 10 made from the said thermoplastic band 5 at the shaping station 9.

At the upstream end 4 of the sterilization zone 3, the latter comprises at least one applicator roller 12 whose position is regulatable and whose application pressure exerted on the sterilization support 1 is adjustable by means of a spring 13. At the downstream end 8 of the sterilization zone 3, the installation can comprise a return and take-up roller 14, whose position can also be regulated and which can be applied to the movable sterilization support 1. In sterilization zone 3, the so-called sterilization chamber is materialised on the one hand by the side of the thermoplastic band which comes into contact with the movable sterilization support 1 and also by that portion of the movable sterilization support surface which comes into contact with the thermoplastic band 5 which, at sterilization temperature adheres hermetically to the said portion of the movable sterilization support surface. As a result of this construction, it is not necessary to place the sterilization support entirely within a sterile enclosure. To prevent the recontamination of the sterilized side of the thermoplastic band 5, it is merely necessary to place the downstream end 8 of the sterilization zone 3 in a sterile enclosure.

Figure 2:
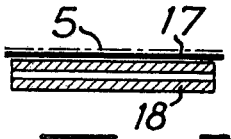
FIG. 2 a cross-section of the installation of FIG. 1 in accordance with the line II—II.

As can be seen in FIGS. 1 and 2, the movable sterilization support 1 comprises two return rollers 15 and 16 which have the same diameter and rotate in the direction of arrow $f_3$, for example in a clockwise direction. This movable sterilization support 1 also comprises an endless conveyor belt 17 constructed from a good conducting material such as a metal or a metal alloy, as well as heating means 18. The heating means 18 can comprise a heating plate or a sole plate located within the space defined by the loop formed by the conveyor belt 17 and preferably immediately below the upper strand **17*a* of said conveyor belt. In other words, the heating means are preferably located immediately downstream of the upstream end 4 of sterilization zone 3. The two return rollers 15 and 16 can also be equipped with heating means. In the case where the heating means are provided for return rollers 15, 16, they are generally associated with the return roller 15 located downstream of the first heating plate 18 between the upper strands 17*a* and the lower strands 17*b* of the endless conveyor belt 17. Cooling means for the thermoplastic band 5 are provided in the vicinity of the downstream end 8 of sterilization zone 3. These cooling means can be materialised for example by a cooling plate 19 located within the space defined by the loop of the endless conveyor belt 17 immediately behind and above the lower strand 17*b* of said conveyor belt 17. The return roller 16 located between the upstream end 4 and the downstream end 8 of the sterilization zone can also be equipped with cooling means. In addition, it is also possible to provide cooling means within the return and take-up roller 14. The cooling of the thermoplastic band 5 level with the downstream end 8 of sterilization zone 3 is preferably sudden and serves to facilitate the separation of thermoplastic band 5 from its movable sterilization support 1, that is to say conveyor belt 17, whilst aiding a slight contraction of thermoplastic band 5. In the area of the downstream end 8 of the sterilization zone, an enclosure 20 has been indicated by dotted lines and said enclosure surrounds the downstream end 8 in a tight manner and can be a sterile enclosure which communicates for example through slot 21, providing a passage for thermoplastic band 5, with sterile enclosure 11. Sterile enclosure 20 prevents the sterilized side of the thermoplastic band from being recontaminated when the latter discontinues its intimate contact with support 1**.

Figure 3:
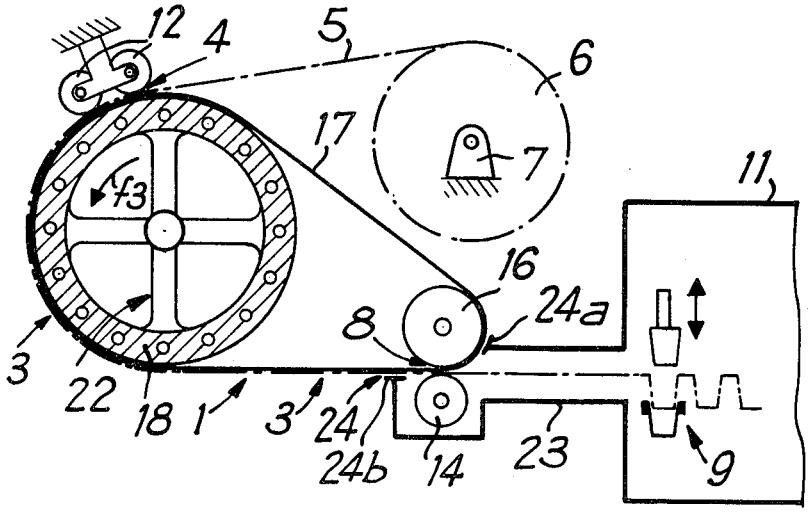
FIG. 3 a schematic elevational view of a second embodiment of the sterilization installation according to the invention.
Figures 7, 8:
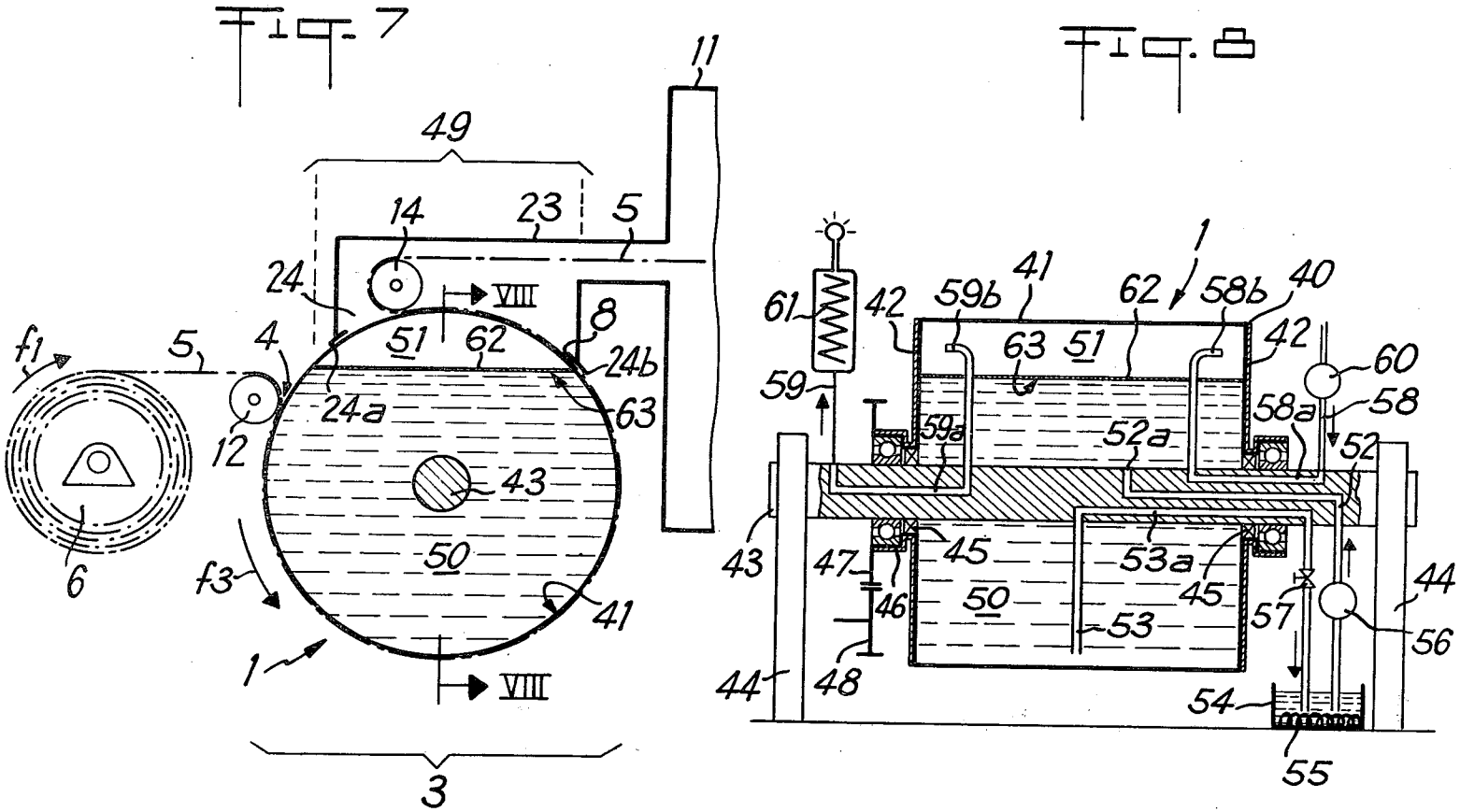
FIG. 7 a schematic elevational view of a fifth embodiment of the invention.
FIG. 8 a vertical section along the line VIII—VIII of FIG. 7.

In the description of the embodiments shown in FIGS. 3 to 9, the same reference numerals are used to the extent that they designate identical or analogous members or elements. The movable sterilization support 1, such as is shown in FIG. 3, has at the upstream end 4 of sterilization zone 3 a return roller 22 in the form of a rotary drum whose peripheral wall comprises heating means 18. Sterilization support 1 could exclusively comprise a rotary heating and/or cooling drum as indicated in FIGS. 3, 7 and 8. However, it is also advantageous to use a second return roller 16 with a much smaller diameter than that of rotary drum 22 and sufficiently remote from the latter that it does not consume too much energy in the case where return roller 16 is provided with cooling means. The sterilization support 1 as shown in FIG. 3 also comprises an endless conveyor belt 17 which passes round drum 22 and return roller 16. The downstream end 8 of sterilization zone 3 has been provided at the position of the cooled return roller 16 with which are associated the take-up applicator rollers 14, thermoplastic band 5 being guided between the two rollers 14, 16 following a plane which is tangential both to drum 22 and to rollers 14 and 16. The take-up applicator roller 14 can also be equipped with cooling means. The sterile enclosure 11 into which the once sterilized thermoplastic band 5 must be introduced after leaving sterilization support 1, is equipped with an intake chamber 23 in which is located the take-up roller 14, thus being applied against the non-sterilized side of thermoplastic band 5. The intake chamber 23 comprises an access opening 24 whose transverse edges **24*a*, 24*b* extend parallel to the axes of the return rollers 14, 16 and drum 22. Obviously, the not shown lateral edges of intake opening 24 are applied substantially tightly against the sides of sterilization support 1. The transverse upper edge 24*a* of intake opening 24 is tightly applied against conveyor belt 17 at the location of return roller 16 immediately downstream of the downstream end 8 of sterilization zone 3. The lower transverse edge 24*b* of intake opening 24 is applied in substantially tight manner against the non-sterile side of thermoplastic band 5 just upstream of the downstream end 8 of sterilization zone 3, whereby in the case shown in FIG. 3 downstream end 8 is substantially located between the two rollers 16 and 14**.

Figure 4:
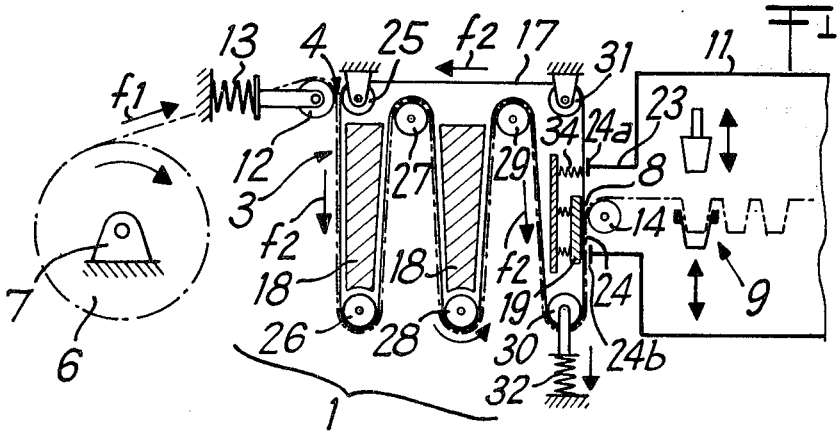
FIG. 4 a schematic elevational view of a third embodiment of the sterilization installation according to the invention.

The sterilization installation shown in FIG. 4 comprises a movable sterilization support 1 equipped with a plurality of return rollers 25 to 31, whereof certain of these (26 to 30) are staggered and define the vertical descending and ascending path of conveyor belt 17 which passes around these various return rollers 25 to 31, whereby that portion of the path between rollers 31 and 25 is preferably horizontal and located above the portions which are inclined relative to the horizontal and which are preferably vertical of the said conveyor belt 17. Return roller 30 located just downstream of intake chamber 23 giving access to the sterile enclosure 11 more particularly comprising a shaping station 9 functions as a tension roller and to this end is equipped with a release spring 32 acting in the sense of placing conveyor belt 17 under tension. Within the space defined by conveyor belt 17, heating plates 18 are placed between two adjacent vertical portions of said conveyor belt 17. The return roller 25 facing applicator roller 12 determines with the latter the upstream end 4 of sterilization zone 3, whose downstream end 8 is located level with the take-up and return roller 15, which is optionally cool and positioned close to the intake opening 24 of access chamber 23. Level with the downstream end 8 of sterilization zone 3, a cooling plate 19 is placed inside the space defined by conveyor belt 17 and directly behind the vertical portion of said belt associated with opening 24 of intake chamber 23, whereby by cooling through conveyor belt 17, a thin surface layer of thermoplastic band 5 cooling plate 19 aids the separation of thermoplastic band 5 and conveyor belt 17. Obviously, the surface cooling of thermoplastic band 5 is inadequate to lower the temperature within the said band 5 to below the softening temperature of the thermoplastic material constituting band 5, whereby the softening temperature corresponds to the shaping temperature of the containers in shaping station 9. It should also be noted that the transverse edges **24*a* and 24*b* are applied tightly on the one hand to conveyor belt 17 downstream of the downstream end 8 of sterilization zone 3 and on the other to the non-sterilized side of the thermoplastic band upstream of the said downstream end 8. It is also possible to provide elastic means such as springs 34 equipped with slide blocks in order to apply conveyor belt 17 to fixed upper transverse edge 24*a* of intake chamber 23**.

Figure 5:
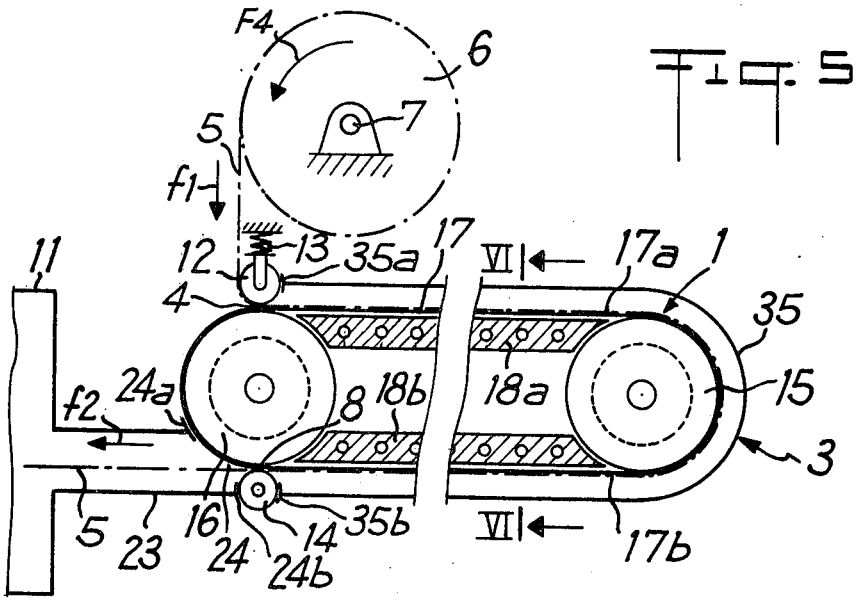
FIG. 5 a schematic elevational view of a fourth embodiment of the sterilization installation according to the invention.
Figure 6:
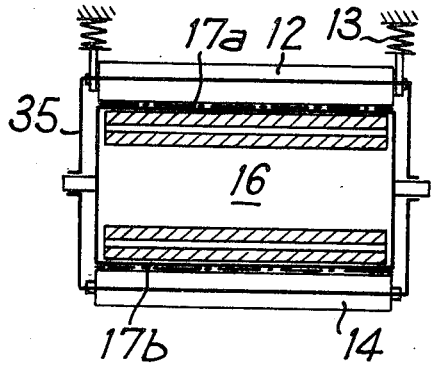
FIG. 6 a cross-section according to the line VI—VI of the installation shown in FIG. 5.

The embodiment shown in FIGS. 5 and 6 is substantially identical to that shown in FIG. 1. The thermoplastic bands 5 stored on a reel 6 which unwinds in the direction of arrow $f_4$ is displaced in a vertically downward direction in accordance with arrow $f_1$ and passes around the return applicator roller 12 before entering an enclosure 35, which is at least relatively tight with reference to the outside atmosphere. Within the enclosure 35 is located the movable sterilization support 1 comprising two return rollers 15 and 16, which have the same diameter and about which passes conveyor belt 17 with two horizontal strands **17*a* and 17*b*. The upstream end 4 of sterilization zone 3 is determined by thermoplastic band 5 coming into adhesive contact with conveyor belt 17 level with applicator roller 12 and return roller 16, whilst the downstream end 8 of said sterilization zone 3 is materialised by the contact area between take-up roller 14, which is optionally cooled, and return roller 16 of sterilization support 1. Within the space defined by conveyor belt 17, the sterilization installation comprises two heating plates 18*a* and 18*b*, whereof one is located between two return rollers 15 and 16 immediately below the upper strand 17*a* and whereof the other is also located between two return rollers 15 and 16, but immediately above the lower strand 17*b* of conveyor belt 17. It should also be noted that the lower plate 18*b* is heated to a temperature below that of the upper plate 18*a* and is at a temperature which is equal to or slightly above the softening temperature, that is to say the shaping temperature of the thermoplastic band 5. The temperature of the upper heating plate 18*a*, which represents the so-called sterilization temperature is of the order of 130° to 240° C. and is preferably of the order of 140° to 220° C., whilst the temperature of the lower heating plate 18*b*** is generally between 110° and 150° C.

The return roller 15 located in sterilization zone 3 between upper strand 17*a* and lower strand 17*b* of conveyor belt 17 optionally comprises cooling means permitting the thermoplastic band 5 to pass from the sterilization temperature radiated by the upper heating plate 18*a* to the shaping temperature radiated by the lower heating plate. It should also be noted that enclosure 35 has transverse edges 35*a* and 35*b*, upper edge 35*a* being applied in a relatively tight manner to applicator roller 12, whilst lower edge 35*b* is applied in relatively tight manner to take-up roller 14. Between enclosure 11 comprising the not shown shaping station and the downstream end 8 of the movable sterilization support 1, is also provided an intake chamber 23, constructed analogously to that shown in FIG. 3. Intake chamber 23 has an access opening 24 defined by transverse edges 24*a* and 24*b*, the upper edge 24*a* being applied to the conveyor belt 17 level with return roller 16 of movable support 1 and lower edge 24*b* being applied, once again in a tight manner, to the periphery of take-up roller 14. The heating time and temperature of conveyor belt 17 are selected in such a way that one side of thermoplastic band 5 becomes adequately sterile. The forward movement of band 5 is preferably in the form of a stepwise movement. The sterilization time is between 10 and 120 seconds. Obviously, it is not impossible for the sterilization treatment to last longer than 120 seconds, but would appear to be unnecessary as a result of the sterilization temperature range chosen and leads to unjustified additional energy consumption.

The embodiment of the sterilization installation shown in FIGS. 7 and 8 has as the sterilization support 1 a rotary drum 40 having a tight casing formed by a peripheral jacket 41 and two lateral circular flanges 42, whereof the central portions are mounted in a tight and rotary manner on a horizontal supporting shaft 43 located in uprights 44. Flanges 42 are for example tightly welded by their periphery to the edges of the cylindrical peripheral jacket 41, made from a thin metallic sheet, for example from steel. Gaskets 45 are provided between shaft 43 and flanges 42 and which bear on the latter via roller bearings 46, whereby at least one of the said flanges is connected via a gear 47, 48 to a rotary drive system. The periphery of drum 40, that is to say jacket 41, is subdivided into a so-called heating sterilization zone 3 and into a cooling zone 49. One of the two zones 3 and 49, i.e. sterilization zone 3, is materialised by a liquid volume 50 which can be heated to temperatures up to 250° C. without any significant evaporation and located in the lower portion of horizontal drum 40, but occupying more than half of said drum, whereby said half is positioned parallel to the axis of drum 43. The other zone, i.e. cooling zone 49, which has a very limited peripheral extension compared with that of sterilization zone 3 is materialised by the remaining volume, the so-called cooling volume 51 located in drum 40 above volume 50 reversed for the heating liquid. The cooling volume 51 is filled by a fluid, for example a relatively cold gaseous fluid, which can be air. A heating liquid supply and discharge circuit 52, 53 with a storage tank 54 equipped with heating means 55, a ram pump 56 and a stop valve 57 passes partly through support shaft 43, which to this end has channels 52*a*, 53*a*. A cooling fluid supply and discharge circuit 58, 59 (whereby the gaseous or liquid cooling fluid must be immiscible with the heating liquid 50) also partly passes through channels 58*a*, 59*a* in support shaft 43 and issues via vertical extension pipes 58*a* and 59*b* to cooling volume 51. Supply circuit 58 can be supplied with air by a single fan 60 and discharge circuit 59 can pass through a heat exchanger 61, located for example in the ambient air, before passing the fluid removed into the atmosphere or before passing it in closed circuit to the suction side of fan 60. A preferably liquid intermediate thermally insulating layer 62, which floats on the hot liquid 50 can be used to separate the two volumes 50 and 51 and for preventing too large a heat exchange between the fluids in volumes 50, 51. It should also be noted that the thermoplastic band 5 unwound from reel 6 in the direction of arrow $f_1$ firstly passes around at least one applicator roller 12 which brings it into contact with the horizontal drum 40 at upstream end 4, that is to say at the start of the hot portion 3 of drum 40. After passing round the periphery of drum 40 in the direction of arrow $f_3$ up to the downstream end 8 of sterilization zone 3 and which is positioned approximately at the start of cooling zone 49 above level 63 of heating liquid 50, thermoplastic band 5 passes into the said cooling zone 49 and leaves drum 40, passing via the take-up and return roller 14 whose position can be regulated along cooling zone 49 so that it can modify the cooling action in a simple manner by acting on the length of the band portion exposed to said cooling. Opening 24 of the access or intake chamber 23 to sterile enclosure 11 tightly surrounds, as in the previously described embodiment, the vicinity of the downstream end 8 of sterilization zone 3. The take-up roller 14 is thus located within opening 24 of intake chamber 23, whose transverse edges 24*a* and 24*b* are applied tightly and respectively to cylindrical jacket 41 downstream of take-up roller 14 and to the non-sterile side of thermoplastic band 5 upstream of said take-up roller 14.

Figure 9:
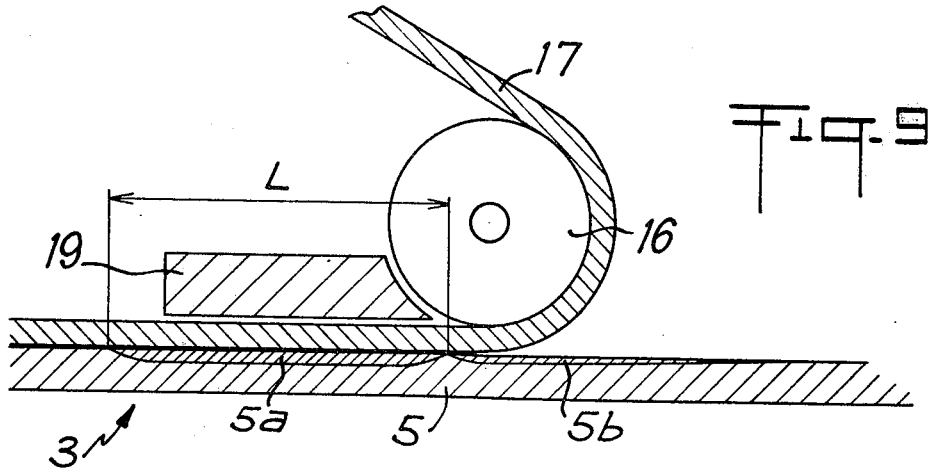
FIG. 9 a detailed section of the area adjacent to the downstream end of the sterilization zone of the sterilization support.

FIG. 9 schematically shows the temporary, surface and locally limited cooling process of the thermoplastic band 5 at the downstream end 8 of sterilization zone 3, whereby it should be understood that the downstream end 8 itself extends over an area which is not strictly comparable with a straight line, whilst said downstream end 8 is not at a strictly fixed location. It is known that thermoplastic band 5 is advanced in stepwise manner, each advance path of a given length L being followed by an also given stop period which is used for the heat-shaping, filling and sealing of the containers. The cooling plate 19 located in the vicinity of return roller 16 and conveyor belt 17 within the loop formed by said belt 17 and upstream of said roller 16 and in the vicinity of the downstream end 8 of sterilization zone 3 transmits its frigories through the conveyor belt 17 to thermoplastic band 15, which is at a sterilization temperature of for example 200° C. The cooling zone, whose dimensions are determined by the cooling plate 19 has for example in the passage direction of band 5 and belt 17 a length L which is at least equal to one advanced step of thermoplastic band 5 and conveyor belt 17. The stoppage time between two successive advance steps of band 5 and the frigorific capacity of cooling plate 19 are calculated in such a way that together they are inadequate for cooling completely thermoplastic band 5. In other words, the frigorific transfer to thermoplastic band 5 only makes it possible to cool a skin area 5*a* of the sterilized side thereof to a temperature causing the surface contraction of said thermoplastic band 5 which interrupts adhesion of band 5 relative to belt 17 or the equivalent or analogous member. The temperature of the cooled skin area 5*a* can be well below the softening or heat-shaping temperature, but when said skin area leaves the cooling area and occupies the following position (zone 5*b*), its temperature increases and rapidly becomes the same as the temperature within the said band and which is close to the sterilization temperature, so that at the location of shaping station 9, the entire thickness of band 5 is at the heat-shaping temperature, which is for example approximately 140° C. Thus, according to one of the advantages of the invention, firstly a good sterilization of the good side of the thermoplastic band is ensured and subsequently the still hot band 5 is used for heat-shaping the containers, with no heating other than that used for its sterilization. The excellent results, both as regards sterilization and energy saving are in particular due to the use of a very good heat conducting heat transfer means, such as metals or metal alloys and the direct contacting of the side of the thermoplastic band to be sterilized with the said heat transfer means.

In certain cases, particularly in the case where the thermoplastic bands are relatively fragile and sticky when hot, it is advantageous to use as the sterilization support a very thin metallic strip 1', for example made from aluminium or aluminium alloy, which rapidly transfers the heat from the heating means 18 or 50. Sterilization support 1', in the form of a thin metallic strip, moves either relative to the heating means 18 (analogously to belt 17 in FIGS. 1, 4 and 5) or with movable heating means 18 and 50 (analogously to the embodiments shown in FIGS. 3, 7 and 8).

Figure 10:
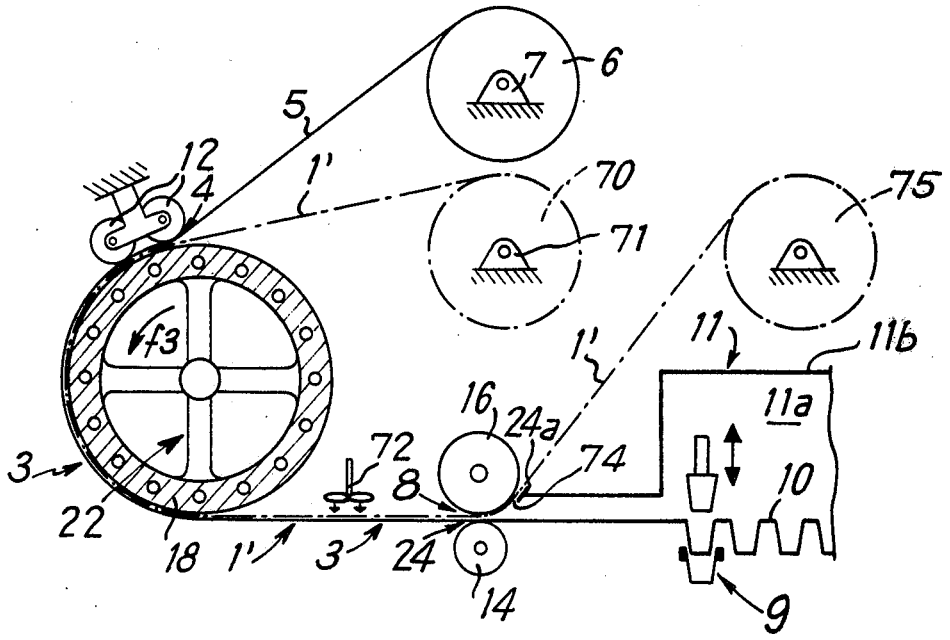
FIGS. 10 and 11 schematically two other embodiments of the sterilization installation for the thermoplastic bands.

The embodiment shown in FIG. 10 differs from that shown in FIG. 3 due to the fact that it uses as the movable sterilization support a thin metallic strip made from aluminium for example and which is unwound from a reel 70 mounted on a bearing 71, whose width is at least equal to that of the thermoplastic band 5 which covers the face of said band 5 which is to constitute the inner wall of the containers to be formed from said band 5 and which is placed between on the one hand the heating means 18, materialised for example by the rotary heating drum 22 and on the other said thermoplastic band 5.

Heating drum 22 heats thermoplastic band 5 to a high sterilization temperature, for example 200° to 300° C. via the metallic strip constituting the movable sterilization support 1'. By means of applicator rollers 12 the members 5 and 1' are drawn tightly against one another and the heat sterilizes the contacting faces thereof. Downstream of rotary drum 22 and upstream of intake opening 24 in sterile enclosure 11, the complex of members 5 and 1' can be cooled, for example by means of a fan 72 in order to reduce the temperature of band 5 to the shaping temperature thereof prior to penetrating between the two rollers 14 and 16 in said sterile enclosure 11. According to the embodiment shown in FIG. 10, intake opening 24 of sterile enclosure 11 is defined by two rollers 14 and 16 and the bottom of said enclosure is materialised by the thermoplastic band 5, with or without the shaped containers 10. The sidewalls **11*a* of enclosure 11 are tightly guided by the edges of thermoplastic band 5 and are covered and interconnected by covering wall 11*b***.

The metallic strip or movable sterilization support 1 is separated from the thermoplastic band 5 as soon as it penetrates sterile enclosure 11. In this case, the non-sterile face of metallic strip 1' remains applied against the upper roller 16 and it is only the sterile face, previously in tight contact with thermoplastic band 5 which briefly passes into said enclosure 11 before leaving it by the outlet slot 74, defined by roller 16 and the upper transverse edge of the intake to said enclosure 11. The metallic strip 1' is then wound onto a reel 75 and can be subsequently reused. It could also be used in the form of a loop in the same way as endless belt 17. Obviously, the members not described in this embodiment but which carry the same reference numerals as mentioned hereinbefore are analogous or identical to those designated thereby hereinbefore. This also applies to the embodiment shown in FIG. 11.

Figure 11:
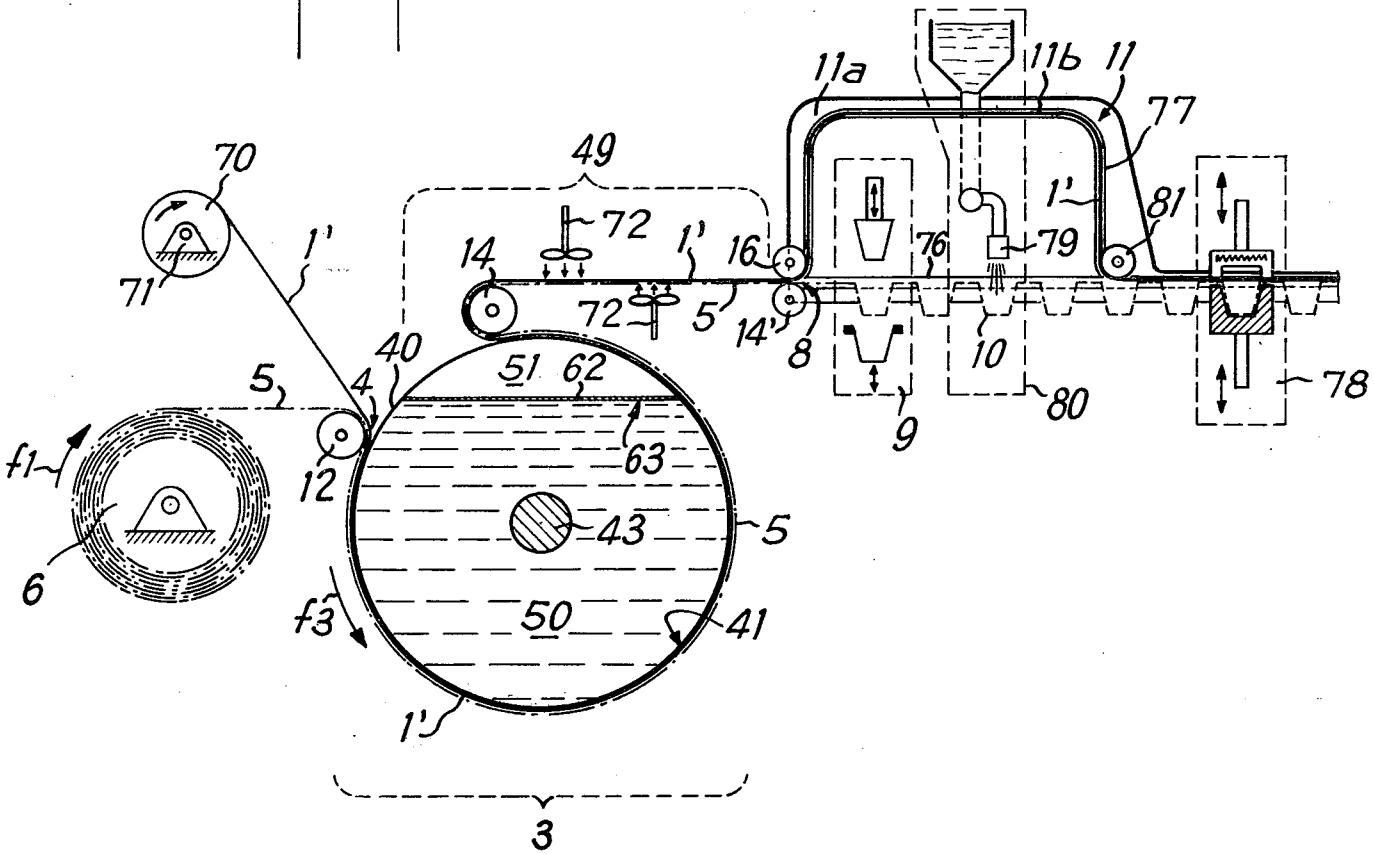

In the embodiment of FIG. 11, the metallic strip 1' unwound from reel 70 is also located between heating means 40, 41, 43, 50 and more specifically rotary drum 40 on the one hand and thermoplastic band 5 on the other. As soon as the band 5 and the strip 1' are brought into contact from applicator roller 12, they are progressively heated to sterilization temperature and then cooled in zone 49, optionally with the aid of a fan 72 to the shaping temperature. Band 5 and strip 1' remain in tight contact with one another until they enter the sterile enclosure 11. Metallic strip 1', made from aluminium, in the present case fulfills two supplementary functions, namely on the one hand that of constituting the covering wall **11*b* of sterile enclosure 11 and on the other that of serving as a sealing cover for the shaped and filled containers 10**.

To this end, enclosure 11 comprises two intake rollers 14' and 16, two rigid lateral supporting walls **11*a*, a base wall constituted by thermoplastic band 5 and a covering wall 11*b* constituted by the thin metallic strip 1'. Due to the fact that the thin metallic strip 1' also serves as the sealing cover for containers 10, it can also be advantageous to provide said strip 1' with a thin layer of a thermally adhesive material on the face turned towards the thermoplastic band 5**.

The two rigid sidewalls **11*a* of sterile enclosure 11 are provided with guide slides 76 and 77, whereby those (76) for the edges of thermoplastic band 5 extend horizontally between the entry point into sterile enclosure 11, materialised by the slot between two rollers 14' and 16 and welding station 78, whilst those (77) for the edges of metallic strip 1' also extend between the pair of rollers 14', 16 and the said welding station 78, but follow an inverted U-shaped path within which are disposed the upper portion of shaping station 9 and the metering device 79 of filling station 80. In other words, metallic strip 1' passes above the shaping station 9 and metering device 79 before rejoining the level of thermoplastic band 5 having containers 10. A pressure roller 81, located upstream of welding station 78 and positioned outside sterile enclosure 11, ensures the application of metallic strip 1' to the upper edge of containers 10 level with thermoplastic band 5. The guide slides 76 and 77** can, for example, be constructed in the manner indicated in French Patent application No. 7,538,785 of December 18, 1975. The thermoplastic band conveying means described in said patent application can be also used in the present case.

The invention is not limited to the embodiments described and represented hereinbefore and various modifications can be made thereto without passing beyond the scope of the invention.

What is claimed is:

1. A method for sterilizing a thermoplastic film for the making of sterile containers by deep drawing under pressure or pneumatic suction of said thermoplastic film at a forming temperature, said method comprising the steps of:

tightly applying the surface of the thermoplastic film which will subsequently form the inside surface of the containers onto a movable solid sterilization support which is heated to sterilization temperature, conveying said movable support with said film applied thereon to the entrance of a sterile enclosure comprising at least parts of forming, filling and sealing stations, maintaining the contact between said movable support and said film until the latter enters the sterile enclosure, and transporting said film into said forming station, within said sterile enclosure, after separation of said support from the film.

2. A method according to claim 1, wherein said film is applied flat directly on said movable solid sterilization support, in accordance with a straight line extending transversely between the longitudinal edges of said film.

3. A method according to claim 1, further comprising the step of cooling said thermoplastic film from said sterilization temperature to said forming temperature.

4. A method according to claim 1, wherein said surface of the thermoplastic film is applied on a heated endless conveyor.

5. A method according to claim 1, wherein said surface of the thermoplastic film is applied on a heated metal strip.

6. A method according to claim 5, wherein said metal strip is separated from said thermoplastic film at the entrance of the latter into said sterile enclosure and is guided along a path above that of said thermoplastic film so as to form at least a part of a covering wall for said enclosure with said metal strip.

7. A method according to claim 6, wherein said metal strip is used for convering the containers formed in said thermoplastic film.

8. A system for the sterilization of a thermoplastic film of a type suitable for use in the making of sterile containers by the deep drawing under pressure or pneumatic suction of said thermoplastic film at a forming temperature, said system comprising:

a supply of thermoplastic film;

a sterile enclosure;

a sterilization zone defined between the thermoplastic film supply and the sterile enclosure;

a conveying means including a movable solid sterilization support for transporting said thermoplastic film through said sterilization zone;

means for applying said thermoplastic film on said sterilization support so that said support extends transversely over the entire width of said thermoplastic film;

heating means positioned in the vicinity of said sterilization support for heating said thermoplastic film conveyed on said support to a sterilization temperature; and guiding means for guiding said support carrying said thermoplastic film to an inlet to said sterile enclosure, with the contact between said film and said sterilization support being maintained until said film enters said sterile enclosure.

9. A sterilization system according to claim 8, wherein the heating means are located inside the movable sterilization support, in the vicinity of the face of said support which comes into contact with said thermoplastic film.

10. A sterilization system according to claim 8, wherein at least the part of said sterilization support which comes into contact with said thermoplastic film is made from a metal or a metal alloy.

11. A sterilization system according to claim 8, further comprising at least one applicator roller for applying said thermoplastic film to said sterilization support.

12. A sterilization system according to claim 11, wherein the position of and pressure applied by the application roller are adjustable.

13. A sterilization system according to claim 8, wherein said sterilization support comprises a rotary drum in which is incorporated said heating means.

14. A sterilization system according to claim 8, wherein said sterilization support comprises a metal strip on which said thermoplastic film is applied.

15. A sterilization system according to claim 8, wherein the sterilization support comprises an endless conveyor belt and at least two return rollers over which said endless belt passes.

16. A sterilization system according to claim 15, wherein at least one of said return rollers is provided with heating means.

17. A sterilization system according to claim 16, wherein said return roller provided with heating means is constructed as a rotary drum with a larger diameter than the other return roller.

18. A sterilization system according to claim 15, wherein said heating means comprises at least one heating plate fixed within the loop formed by said conveyor belt.

19. A sterilization system according to claim 18, wherein said heating plate is positioned below the upper strand of said conveyor belt.

20. A sterilization system according to claim 15, wherein said heating means comprises a plurality of heating plates located within the loop formed by said conveyor belt and wherein one of said heating plates is fixed adjacent to and below the upper strand of said conveyor belt and another heating plate is fixed adjacent to and above the lower strand of said conveyor belt.

21. A sterilization system according to claim 15, wherein said sterilization support passes onto more than two rollers, said return rollers being positioned in such a way as to define for said conveyor belt which passes around them a path having at least two portions which are inclined relative to the horizontal, in such a way that the strands of said conveyor belt located on said inclined portions are preferably at least approximately vertical.

22. A sterilization system according to claim 21, wherein the return rollers associated with the approximately vertical strands of said conveyor belt are staggered.

23. A sterilization system according to claim 21, wherein a heating plate is positioned at least between the first two approximately vertical strands of said conveyor belt, said strands following the upstream end of said sterilization zone.

24. A sterilization system according to claim 18, wherein said heating means comprises at least first and second heating plates located one after the other along the path of said sterilization support through said sterilization zone, said first heating plate being heated to a temperature above that of the second heating plate, which is heated to a temperature at least equal to the forming temperature of said thermoplastic film.

25. A sterilization system according to claim 15, comprising a return roller which is positioned on the path of said thermoplastic film on said endless conveyor belt between first and second heating plates heated to different temperatures, and which is constructed as a cooling roller provided with cooling means.

26. A sterilization system according to claim 9, further comprising cooling means located near the downstream end of said sterilization zone for reducing the temperature of the face of said thermoplastic film which is in contact with said sterilization support, thereby causing a slight contraction of said film in order to aid its separation from said sterilization support.

27. A sterilization system according to claim 15, further comprising cooling means disposed within a conveyor belt return roller located at the downstream end of said sterilization zone.

28. A sterilization system according to claim 15, further comprising cooling means including a cooling roller which is located outside the loop formed by said conveyor belt at the downstream end of the sterilization zone, said cooling roller being applied against said conveyor belt, preferably at the location of a return roller at the downstream end of said sterilization zone.

29. A sterilization system according to claim 15, further comprising cooling means including a cooling plate facing said conveyor belt within the loop formed by the latter at the downstream end of said sterilization zone.

30. A sterilization system according to claim 15, wherein a take-up and return roller is provided at the downstream end of the sterilization zone outside the loop formed by said conveyor belt, said roller being drawn in the direction of said conveyor belt.

31. A sterilization installation according to claim 9, wherein said sterile enclosure is provided with an intake chamber for receiving the thermoplastic film as it leaves said sterilization support.

32. A sterilization system according to claim 31, wherein said intake chamber has an opening with two transverse edges made in the sterile enclosure and bordering in tight manner the downstream end of said movable sterilization support, whereby a first of the transverse edges of said opening is applied in a substantially tight manner against the non-sterilized face of the thermoplastic film and the second transverse edge is applied in a substantially tight manner against the sterile face of said sterilization support, constituted by an endless conveyor belt, downstream of the separation point between said conveyor belt and said thermoplastic film.

33. A sterilization system according to claim 32 and further comprising cooling means provided in the zone defined by said two transverse edges of the opening of said intake chamber.

34. A sterilization system according to claim 32, further comprising a take-up and return roller provided outside the loop formed by said conveyor belt in the zone defined by said two transverse edges.

35. A sterilization system according to claim 34, wherein the position of the take-up and return roller can be regulated along the sterilization support between the two transverse edges of the intake chamber.

36. A sterilization system according to claim 32, further comprising a roller which is located between said first transverse edge and said thermoplastic film which has a cooling action, and whose circumference is applied in tight manner both against said first transverse edge and said non-sterile face of the thermoplastic film, whereby the circumference of this roller moves synchronously with the thermoplastic film.

37. A sterilization system according to claim 32, wherein said second transverse edge is applied in tight manner against a face of said conveyor belt at a location where said conveyor belt is supported on its other face by a return roller.

38. A sterilization system according to claim 32, wherein said second transverse edge is applied in tight manner against a face of said conveyor belt at a location where said conveyor belt is supported on its other fact by elastic application means.

39. A sterilization system according to claim 13, wherein said heating means incorporated in the rotary drum comprises a hot liquid filling most of the inside volume of said drum and defining a zone for sterilization on the peripheral surface of said drum.

40. A sterilization system according to claim 39, wherein the peripheral surface of said rotary drum comprises a cooling zone for the thermoplastic film, in addition to the zone for sterilization.

41. A sterilization system according to claim 39, wherein cooling means are incorporated into said rotary drum, in addition to the heating means.

42. A sterilization system according to claim 41, wherein said incorporated cooling means comprises a gaseous or liquid fluid which is at least slightly immiscible with the hot liquid of the heating means incorporated in said rotary drum.

43. A sterilization system according to claim 41, wherein said incorporated cooling means are positioned above the heating means within the rotary drum.

44. A sterilization system according to claim 43, wherein a thermal insulation layer floating on the liquid of the heating means is provided in said rotary drum.

45. A sterilization system according to claim 44, wherein said thermal insulation layer is liquid.

46. A sterilization system according to claim 32, wherein said sterilization support comprises a rotary drum whose peripheral surface comprises a zone for sterilization and a cooling zone for said thermoplastic film and wherein said edges of the openings of the intake chamber are applied in tight manner respectively to the non-sterile side of the thermoplastic film and to said rotary drum in the marginal portion of the cooling zone of said drum.

47. A sterilization system according to claim 8, wherein in the sterilization zone, the edges of said movable sterilization support and of said thermoplastic film are applied tightly against one another.

48. A sterilization system according to claim 8, wherein the movable sterilization support comprises a thin metallic strip on which is applied said thermoplastic film and wherein means are provided for separating said metallic strip from said thermoplastic film at the intake to said sterile enclosure.

49. A sterilization system according to claim 48, wherein said thin metallic strip constitutes at least a part of a covering wall of said sterile enclosure.

50. A sterilization system according to claim 49, wherein said thin metallic strip comprises at least a part of a sealing cover for the containers formed in the thermoplastic film.

* * * * *